US007969401B2

(12) United States Patent
Ito

(10) Patent No.: US 7,969,401 B2
(45) Date of Patent: Jun. 28, 2011

(54) LIQUID CRYSTAL DRIVING APPARATUS WITH MASKED LATCH PULSE GENERATING CIRCUIT

(75) Inventor: Hideo Ito, Gunma-ken (JP)

(73) Assignees: Sanyo Electric Co., Ltd., Osaka (JP); Sanyo Semiconductor Co., Ltd., Gunma (JP)

( * ) Notice: Subject to any disclaimer, the term of this patent is extended or adjusted under 35 U.S.C. 154(b) by 713 days.

(21) Appl. No.: 12/055,251

(22) Filed: Mar. 25, 2008

(65) Prior Publication Data

US 2009/0040213 A1 Feb. 12, 2009

(30) Foreign Application Priority Data

Mar. 26, 2007 (JP) ..... 2007-080047

(51) Int. Cl.
*G09G 3/36* (2006.01)

(52) U.S. Cl. ..... 345/98; 345/100

(58) Field of Classification Search ..... 345/98, 345/99, 100

See application file for complete search history.

(56) References Cited

U.S. PATENT DOCUMENTS 5,323,438 A * 6/1994 Kim ..... 377/54
6,177,920 B1 * 1/2001 Koyama et al. ..... 345/100
6,894,673 B2 * 5/2005 Koga et al. ..... 345/99
7,042,425 B2 * 5/2006 Yamaguchi et al. ..... 345/76
7,471,270 B2 * 12/2008 Tomohara ..... 345/77

FOREIGN PATENT DOCUMENTS

JP 2004-274335 9/2004

* cited by examiner

*Primary Examiner* — Chanh Nguyen
*Assistant Examiner* — Roy Rabindranath
(74) *Attorney, Agent, or Firm* — SoCal IP Law Group LLP; Steven C. Sereboff; John E. Gunther

(57) ABSTRACT

A liquid crystal driving apparatus comprising: a latch circuit including latch-areas each in n-bit unit, configured to sequentially latch into a designated latch-area, pieces of n-bit display-data obtained by dividing m-bit display-data for driving column-electrodes corresponding to each row-electrode of a liquid crystal display panel including row and column-electrodes; a data-register configured to sequentially hold the pieces of n-bit display-data; and a latch-pulse generating circuit configured to generate a latch-pulse for latching the n-bit display-data into the designated latch-area every time the data-register holds the n-bit display-data, including: a counter whose count-value changes every time the data-register holds the n-bit display-data; a decoder configured to decode the count-value to generate the latch-pulse; and a masking circuit configured to mask generation of the latch-pulse from the decoder in a period of time during which the count-value is changed, the column-electrodes being driven based on the m-bit display-data from the latch circuit.

3 Claims, 6 Drawing Sheets

LIQUID CRYSTAL DRIVING APPARATUS WITH MASKED LATCH PULSE GENERATING CIRCUIT

CROSS-REFERENCE TO RELATED APPLICATION

This application claims the benefit of priority to Japanese Patent Application No. 2007-080047, filed Mar. 26, 2007, of which full contents are incorporated herein by reference.

BACKGROUND OF THE INVENTION

1. Field of the Invention

The present invention relates to a liquid crystal driving apparatus.

2. Description of the Related Art

There is generally known a liquid crystal driving apparatus driving a liquid crystal display panel (e.g. TFT) with a plurality of row electrodes and a plurality of column electrodes that includes a gate driver for driving a plurality of the row electrodes, and a source driver for driving a plurality of the column electrodes (see Japanese Patent Laid-Open Patent Publication No. 2004-274335).

FIG. 7 is a block diagram of a liquid crystal display panel, a gate driver, and a source driver.

As shown in FIG. 7, a liquid crystal display panel 100 includes a plurality of column electrodes 101 and a plurality of row electrodes 102 that are intersected by the plurality of column electrodes 101, and a plurality of FETs 103, each of which is arranged at a position of each of intersections between a plurality of the column electrodes 101 and the row electrodes 102. A gate and a source of each FET 103 are respectively connected to the row electrode 102 and the column electrode 101 at a position where these electrodes intersect each other. A capacitor 104 to be charged with electric charge for displaying is provided between a drain of each FET 103 and ground. A source driver 105 outputs a signal for driving all the column electrodes 101 for one row intersected by each of the row electrodes 102. When a gate driver 106 selectively outputs a signal for driving the row electrodes 102 for one row, the electric charge is charged in the capacitors 104 connected to the FETs 103 of all the column electrodes 101 for one row. By repeating the above-described processing, which is performed row by row, for all the rows of the liquid crystal display panel 100, the liquid crystal display panel 100 is enabled to display an image.

FIG. 8 is a block diagram showing an example of the source driver 105 shown in FIG. 7.

The source driver 105 includes a data register 200, latch circuits 201 and 204, latch pulse generating circuits 202 and 203, a digital-to-analog (D/A) converter 205, and a source output circuit 206.

The latch circuit 201 latches m bits of data. Here, m is a number obtained by multiplying the number of the column electrodes 101 in all the column electrodes 101 for one row intersected by each of the row electrodes 102 in the liquid crystal display panel, by a bit number j that is a digital value of each row electrode in the D/A converter 205. The latch circuit 201 includes latch areas 201-1 to **201-*x* in which m bits are divided into groups of n bits, and sequentially latches n bits of data until m bits of data are latched into the latch area selected from the latch areas 201-1 to 201-*x***.

The data register 200 holds n bits of data that are an object to be latched into the latch areas 201-1 to **201-*x* of the latch circuit 201 and externally supplied at an appropriate timing. These n bits of data include display data for driving the column electrodes 101 of the liquid crystal display panel 100 to display. The latch pulse generating circuit 202 generates latch pulses LP1 to LPx which designate one of the latch areas 201-1 to 201-*x* every time the data register 200 holds n bits of data. By sequentially generating the latch pulses LP1 to LPx, m bits of data are latched into the latch circuit 201**.

The latch circuit 204 latches m bits of data latched in the latch circuit 201. The latch pulse generating circuit 203 generates a latch pulse LP' every time the latch circuit 201 latches m bits of data. By generating the latch pulse LP', m bits of data in the latch circuit 201 are latched into the latch circuit 204.

The D/A converter 205 converts a digital value of m bits of data latched in the latch circuit 204 into an analog value thereof. The source output circuit 206: performs a signal processing, such as amplifying a voltage of an analog signal output from the D/A converter 205 to a sufficient level for driving the FET 103; and thereafter, applies the signal-processed signal to the source electrode of the FET 103 connected to the column electrode 101.

In other words, every time n bits of data are held in the data register 200, the latch pulses LP1 to LPx are generated by the latch pulse generating circuit 202 in an appropriate order, and the n bits of data are latched into one of the designated area 201-1 to **201-*x* in the latch circuit 201. Every time m bits of data in all latch areas are latched in the latch circuit 201, the latch pulse LP' is generated, and m bits of data are latched into the latch circuit 204. The D/A converter 205 and the source output circuit 206 perform the signal processing for m bits of data latched in the latch circuit 204, to be output as a signal for driving all the column electrodes 101** for one row.

However, if extraneous noise such as noise causing a logic circuit included in the latch pulse generating circuit 202 to malfunction is supplied to the latch pulse generating circuit 202, a latch pulse may not be generated for a latch area, into which n bits of data should originally be latched, of a plurality of the latch areas 201-1 to **201-*x* making up the latch circuit. In such a case, since bits of the display data do not become in a one-to-one correspondence with the column electrodes, there are problems such that the liquid crystal display panel 100** is unable to display a desired image.

SUMMARY OF THE INVENTION

A liquid crystal driving apparatus according to an aspect of the present invention, comprises: a latch circuit including a plurality of latch areas each in n-bit unit, the latch circuit being configured to sequentially latch a plurality of pieces of n-bit display data into a designated latch area of the latch areas, the plurality of pieces of n-bit display data being obtained by dividing m-bit display data for driving column electrodes corresponding to each of row electrodes of a liquid crystal display panel including a plurality of the row electrodes and a plurality of the column electrodes; a data register configured to sequentially hold the plurality of pieces of n-bit display data; and a latch pulse generating circuit configured to generate a latch pulse for latching the n-bit display data into the designated latch area every time the data register holds the n-bit display data, the latch pulse generating circuit including: a counter whose count value changes every time the data register holds the n-bit display data; a decoder configured to decode the count value of the counter to generate the latch pulse; and a masking circuit configured to mask generation of the latch pulse from the decoder in a period of time during which the count value of the counter is changed, the column electrodes being driven based on the m-bit display data output from the latch circuit.

Other features of the present invention will become apparent from descriptions of this specification and of the accompanying drawings.

BRIEF DESCRIPTION OF THE DRAWINGS

At least the following details will become apparent from descriptions of this specification and of the accompanying drawings.

DETAILED DESCRIPTION OF THE INVENTION

At least the following details will become apparent from descriptions of this specification and of the accompanying drawings.

===Configuration of Liquid Crystal Driving Apparatus===

Figure 1:
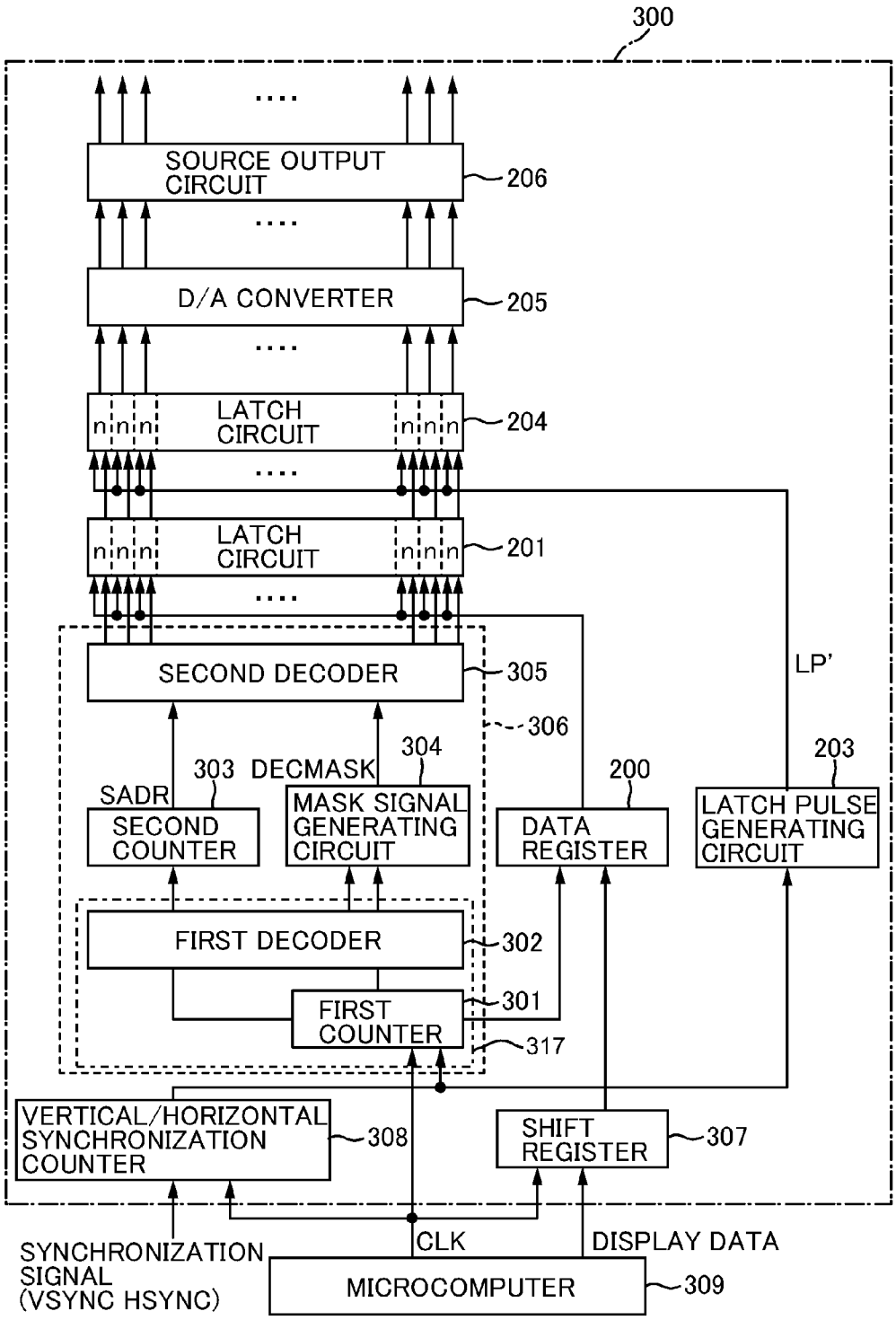
FIG. 1 is a block diagram of a liquid crystal driving apparatus according to an embodiment of the present invention.
Figure 8:
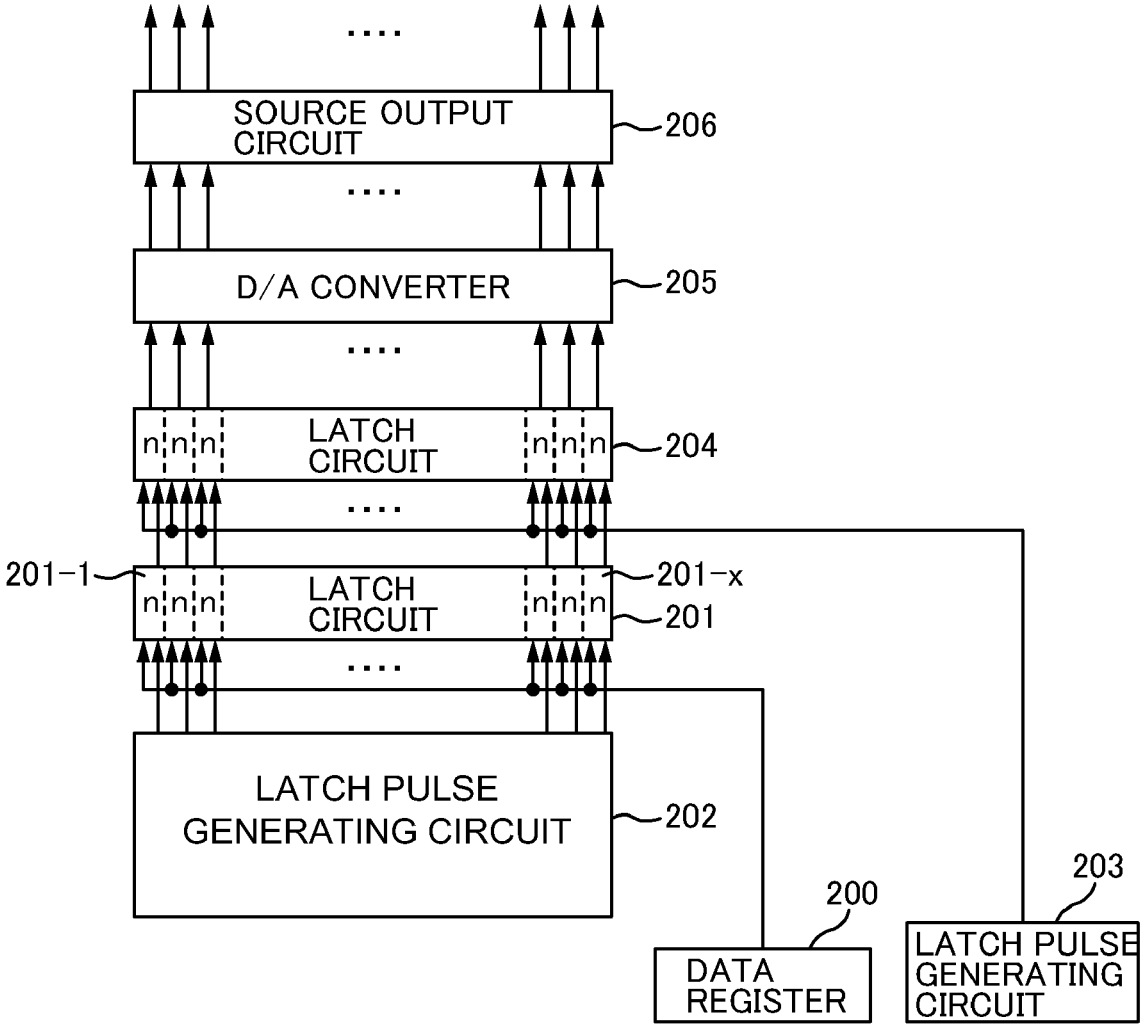
FIG. 8 PRIOR ART
FIG. 8 is a block diagram of a general liquid crystal driving apparatus.

FIG. 1 is a block diagram of a liquid crystal driving apparatus according to an embodiment of the present invention, which drives column electrodes 101 of the liquid crystal display panel 100. In a configuration shown in FIG. 1 elements having the same structure as those shown in FIG. 8 are provided with the same reference numerals, and descriptions thereof are omitted. A microcomputer shown in FIG. 1 may be included as a constituent element in the liquid crystal driving apparatus. However, in an embodiment according to the present invention, description will hereinafter be given such that the liquid crystal driving apparatus includes a configuration of a source driver exclusive of the microcomputer and is made up of an integrated circuit. This integrated circuit may also be an integrated circuit of one chip including a gate driver for driving a row electrode 102 of the liquid crystal display panel 100.

In FIG. 1, a liquid crystal driving apparatus 300 includes a data register 200, latch circuits 201 and 204, latch pulse generating circuits 203 and 306, a D/A converter 205, a source output circuit 206, a shift register 307, and vertical/horizontal synchronization counter 308. Furthermore, the latch pulse generating circuit 306 includes a first counter 301 (counting unit), a second counter 303 (counter), a first decoder 302 (decoding unit), a mask signal generating circuit 304 (masking circuit), and a second decoder 305 (decoder).

A microcomputer 309, which is a peripheral device of the liquid crystal driving apparatus 300, outputs display data in m-bit unit for driving a column electrode 101 of the liquid crystal display panel 100 on a row-by-row basis.

Figure 7:
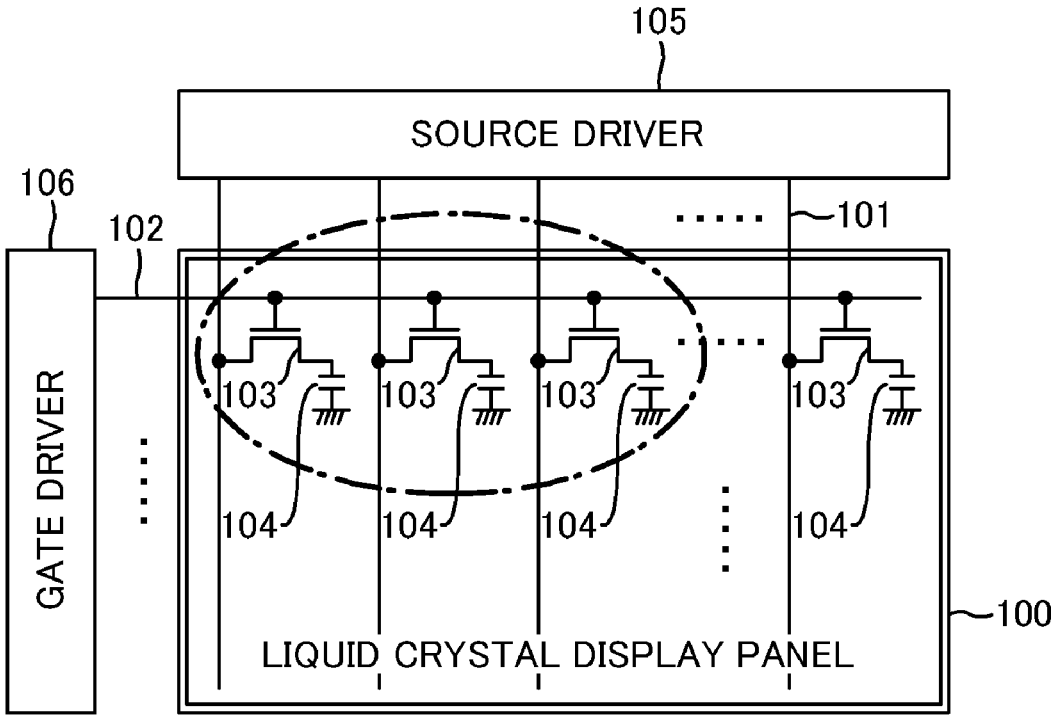
FIG. 7 PRIOR ART
FIG. 7 is a block diagram showing a general structure of a liquid crystal display panel, a gate driver, and a source driver.

For the sake of convenience in description, it is assumed here that the number of the column electrode 101 per row of the liquid crystal display panel 100, shown in FIG. 7, is 480, and the number of the row electrodes 102 is 120, for example. Also it is assumed that the number of bits j, which is a digital value of each column electrode of the D/A converter 205 shown in FIG. 1, is 8 bits, and the bit width of the display data output from the microcomputer 309 is also 8 bits, for example. That is, in this case, the bit number m, which is the number of the display data for driving the column electrodes 101 for one row, is 480×8 bits. The display data of three pixels, each of which respectively corresponding to R, G, and B signals, are output to three of the column electrode 101 which are adjacent one another. In other words, the row electrode 102 intersected by these column electrodes is selected by a gate driver 106, and the FETs 103 are driven by these display data of three pixels, to be able to display of one dot (an area surrounded by a single-dotted line in FIG. 7) on the liquid crystal display panel 100. Therefore, in this case, 160 dots can be displayed in one row of the liquid crystal display panel 100.

The vertical/horizontal synchronization counter 308 is input with a vertical synchronization signal VSYNC, a horizontal synchronization signal HSYNC, and the clock CLK, which are required in displaying an image on the liquid crystal display panel 100, from outside of the liquid crystal driving apparatus 300. The horizontal synchronization signal HSYNC is generated every time the column electrodes 101 for one row are driven. After being reset by the horizontal synchronization signal HSYNC, the vertical/horizontal synchronization counter 308 starts counting the clock CLK. In other words, the vertical/horizontal synchronization counter 308 repeats the above counting operation every time one row is displayed on the liquid crystal display panel 100.

The shift register 307 is a register of n bits, and holds the display data, which is in m-bit unit, output from the microcomputer 309 by n-bit unit in synchronization with the clock CLK.

The first counter 301 is input with the clock CLK, and repeats counting the clock CLK of cycle k. The first counter 301 outputs a hold signal for causing the data register 200 at the next stage to hold the display data of n bits held in the shift register every time the clock CLK of cycle k is counted. Since the shift register 307 and the first counter 301 operate in accordance with the common clock CLK, the shift register 307 holds the n-bit display data at the same timing as the first counter 301 counts the clock CLK of cycle k. The data register 200 holds the display data of n-bit, which are sequentially held in the shift register 307, every time the data register 200 is input with a hold signal from the first counter 301.

The first decoder 302 changes a count value of the second counter 303, by incrementing by one, for example, every time the first counter 301 counts the clock CLK of cycle k. The first counter 310 and the first decoder 302 collectively form a signal output circuit 317.

The second decoder 305 generates any one of latch pulses LP1 to LPx which respectively corresponds to latch areas 201-1 to **201-*x*, each in n-bit unit, in the latch circuit 201, depending on a decoding result obtained by decoding the count value of the second counter 303. Here, since the second decoder 305 makes the decoding result of the count value of the second counter 303 to correspond to one of the latch pulses LP1 to LPx, the count value of the second counter 303 could cause a problem during a transitional period during which the count value of the second counter 303 is changed. For example, delay of a signal on a signal connection line of an element included in the second counter 303, might cause generation of an erroneous count during the transitional period. In such a case, during the transitional period of the count value of the second counter 303, an erroneous latch pulse might be generated for a latch area, where the display data should not originally be latched, in the latch circuit 201. This could result in an erroneous display on the liquid crystal display panel 100. Thus, it is necessary to provide a measure for preventing the display data from being latched into an incorrect latch area of the latch circuit 201**.

The mask signal generating circuit 304 prevents the second decoder 305 from generating an erroneous latch pulse during the transitional period of the count value of the second counter 303. More specifically, the mask signal generating circuit 304 generates a mask signal DECMASK for masking the count value of the second counter 303 during the transitional period depending on the decoding result of the count value of the first counter 301 by the first decoder 302.

The latch pulse generating circuit 203 is input with the count value of the vertical/horizontal synchronization counter 308. After the latch circuit 201 latches the m-bit display data, the latch pulse generating circuit 203 outputs to the latch circuit 204 the latch pulse LP' with which the m-bit display data in the latch circuit 201 is latched by the latch circuit 204, while the vertical/horizontal synchronization counter 308 counts a predetermined number of clock pulses of the clock CLK.

===Configuration of Latch Pulse Generating Circuit 306===

Figure 2:
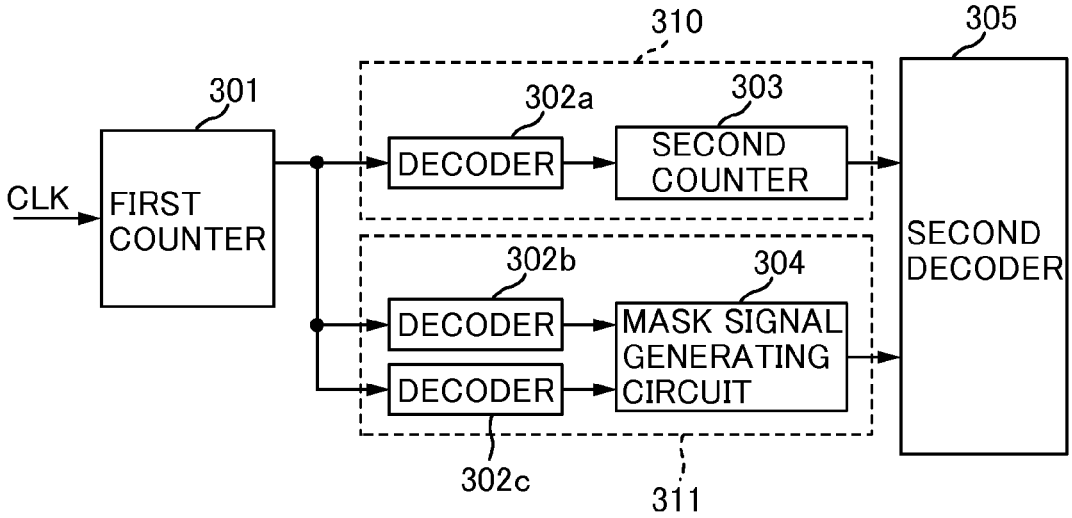
FIG. 2 is a block diagram of a configuration of a latch pulse generating circuit 306 in a liquid crystal driving apparatus of FIG. 1.

FIG. 2 is a block diagram for showing an example of a configuration of the latch pulse generating circuit used in the liquid crystal driving apparatus according to the present invention. Hereinafter, for the sake of convenience in description, it is assumed here that k=6. In other words, the first counter 301 counts count values from 1 to 6 (in decimal) repeatedly in synchronization with a rising edge of the clock CLK. The first decoder 302 includes decoders 302*a*, 302*b*, and 302*c*. The decoder 302*a* outputs a first detection signal when the first counter 301 counts the count value of 6. The decoder 302*b* outputs a second detection signal when the first counter 301 counts the count value of 5. The decoder 302*c* outputs a third detection signal when the first counter 301 counts the count value of 2. The second counter 303 is an 8-bit counter, for example, counting the count values from 0 to 127 (in decimal). When the decoder 302*a* outputs the first detection signal, that is, when the first counter 301 counts the count value of 6, the second counter 303 is incremented by +1. When the decoder 302*b* outputs the second detection signal, that is, when the first counter 301 counts the count value of 5, the mask signal generating circuit 304 outputs a high-level. When the decoder 302*c* outputs the third detection signal, that is, when the first counter 301 counts the count value of 2, the mask signal generating circuit 304 outputs a low-level signal.

Figure 3:
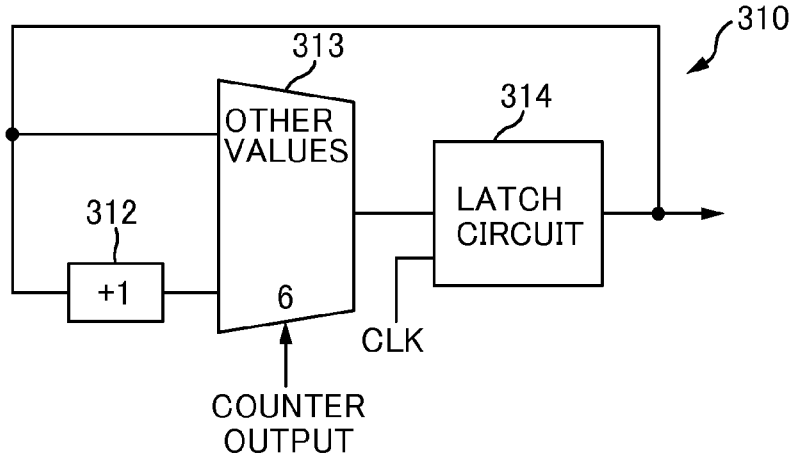
FIG. 3 is a diagram of an embodiment of a block 310 surrounded by a single-dotted line in FIG. 2.

FIG. 3 is a diagram showing a specific embodiment of a single-dotted block 310, shown in FIG. 2, including the decoder 302*a* and the second counter 303. The single-dotted block 310 can be replaced by a +1 adder 312, a determiner 313 determining if the count value of the first counter 301 is 6 or other than 6, a latch circuit 314 latching an output from the determiner 313 at the timing of the clock CLK. For example, if the first counter 301 outputs the count value other than 6, an output of the latch circuit 314 is passed through the determiner 313 as it is, and the latch circuit 314 latches the same value again. If the first counter 301 outputs the count value of 6, the output of the latch circuit 314 is incremented by one at the +1 adder 312, and thereafter, passes through the determiner 313, to be latched to the latch circuit 314. In other words, every time the first counter 301 counts the count value of 6, the output of the latch circuit 314 is incremented by one, thus realizing a function of the second counter 303.

Figure 4:
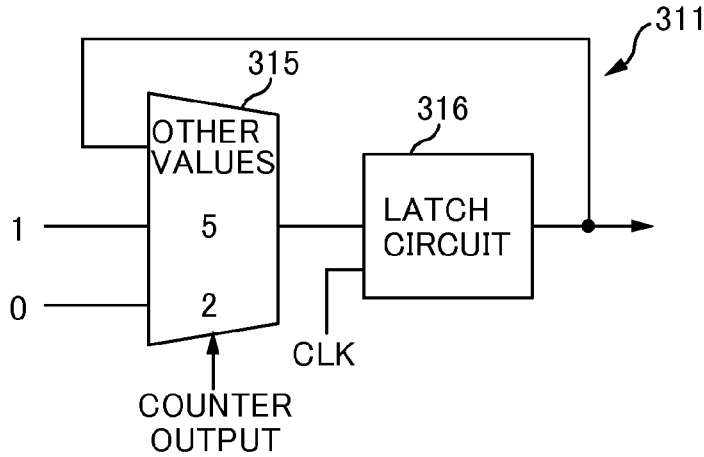
FIG. 4 is a diagram of an embodiment of a block 311 surrounded by a single-dotted line of FIG. 2.

FIG. 4 is a diagram showing a specific embodiment of a single-dotted block 311, shown in FIG. 2, including the decoders 302*b* and 302*c* and the mask signal generating circuit 304. In other words, the single-dotted bock 311 can be replaced by a latch circuit 316 and a determiner 315 determining if: the count value of the first counter 301 is 5 or 2; or the count value other than 5 and 1. The determiner 315 is applied with a voltage that is invariably at a high level, and a voltage that is invariably at a low level. For example, if the first counter 301 outputs the count value of 5, the determiner 315 outputs a signal at the high level, and the latch circuit 316 latches the high level signal. If the first counter 301 outputs the count value of 1, the determiner 315 outputs a signal at the low level, and the latch circuit 316 latches the low level signal. If the first counter 301 outputs the count value other than 5 and 1, the determiner 315 allows the latched signal being latched to the latch circuit 316 at that time, to be passed therethrough as it is, and allows the latch circuit 316 to latch the signal again. In other words, in a period during which the count value of the first counter 301 is 6, 1, or 2, the output of the latch circuit 316 is at the high level, and in a period during which the count value of the first counter 301 is 3, 4, or 5, the output of the latch circuit is at the low level. That is, there can be realized a function of the mask signal generating circuit 304, which generates the mask signal DECMASK at the high level, in a period fully including the transitional period during which the count value of the second counter 303 is changed.

Figure 5:
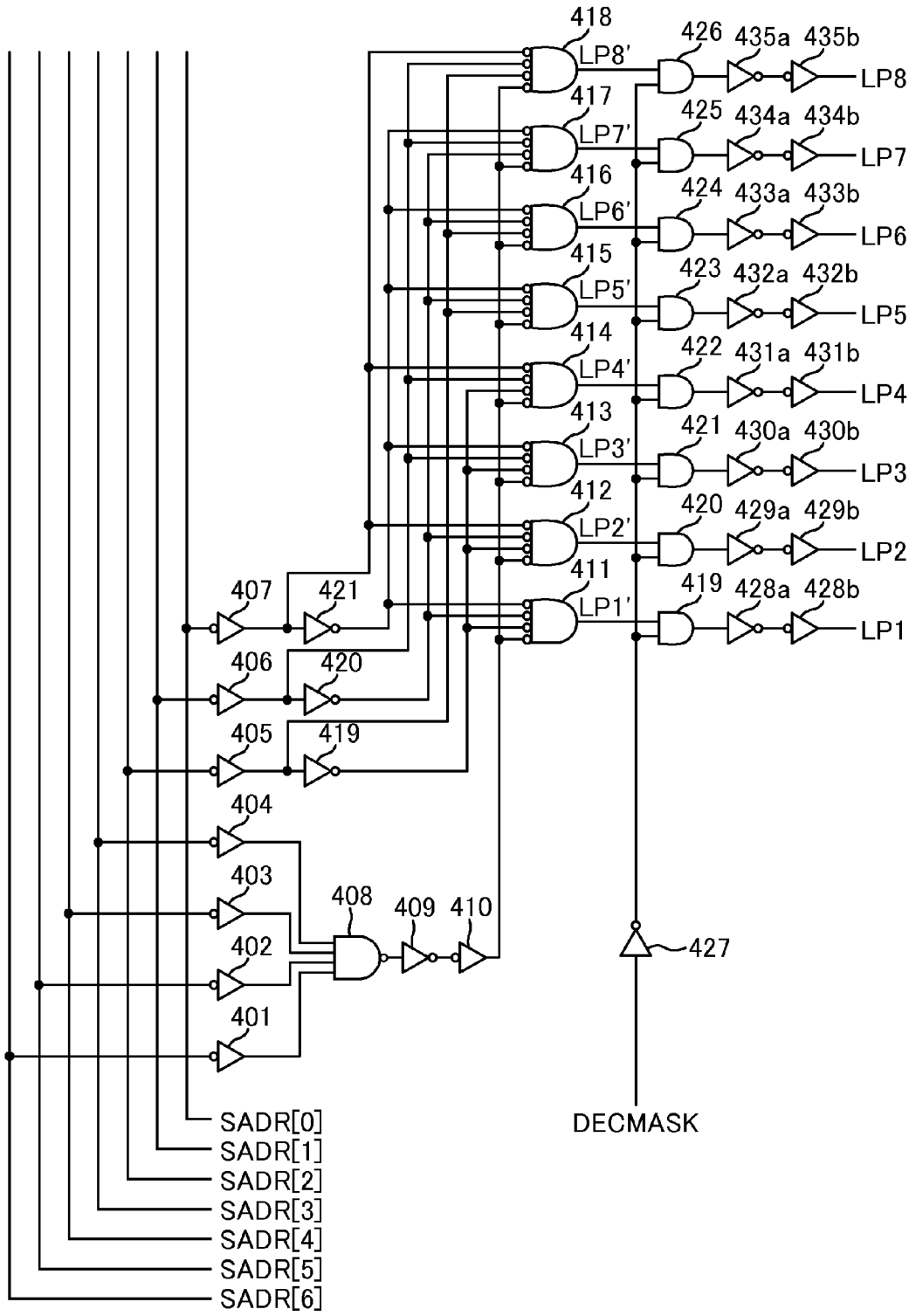
FIG. 5 is a diagram of a specific example of a second decoder 305 of FIG. 1.

FIG. 5 is an embodiment of the second decoder 305 realized by using a logic circuit. Because it is assumed that k=6, the number of the latch pulses LP1 to LPx to be generated by the second decoder 305, is 80. FIG. 5 illustrates an embodiment where the latch pulses LP1 to LP8 are output. The latch pulses LP9 to LP80 can be generated by a configuration of a logic circuit pursuant to the same logic as that shown in FIG. 5. Therefore, description of a configuration in which the latch pulses LP9 to LP80 are generated is omitted herein. The second counter 303 is a 7-bit counter including SADR (6) (the highest-order bit) to SADR (0) (the lowest-order bit), and outputs the count values from 0 to 127 (in decimal).

In FIG. 5, each bit in the second counter 303 is input to inverters 401-407, from the highest-order bit thereof. Outputs from the inverters 401-404 are input to an NAND circuit 408, and an output from the NAND circuit 408 is input to each one of input terminals of NOR circuits of four-input and one-output type 411-418 via two-staged inverters 409 and 410. Outputs from the inverters 405 to 407 are selectively input to the NOR circuits 411 to 418, as they are or via inverters 419, 420, and 421. Each of outputs from the NOR circuits 411 to 418 is respectively input to each one of the input terminals of the AND circuits 419 to 426, and the mask signal DECMASK is input to the other input terminals of the AND circuits 419 to 426 via an inverter 427, as a common signal for opening or closing gates of the AND circuits 419 to 425. Outputs from the AND circuits 419 to 426 are output as the latch pulses LP1 to LP8, respectively, via two-staged inverters 428*a* to 435*a*, 428*b* to 435*b*.

Description will hereinafter be given assuming that the count value of the second counter 303 is 0, for example. In this case, all of SADR(6) to SADR(0), each of which is a bit in the second counter 303, are 0. Therefore, the inverter 410 outputs the low level to all of the one input terminals of the NOR circuits 411 to 418. The remaining three input terminals of the NOR gate 411 are input with the low level outputs from the inverters 419 to 421. At this time, the NOR circuit 411 is only a circuit of which all the four input terminals receive the low levels. For other NOR circuits 412-418, any of the four input terminals thereof receives the high level. Therefore, only the NOR circuit 411 outputs the LP1' of high level, and other NOR circuits 412 to 418 output the LP2' to LP8' of low level.

In other words, the NOR circuit 411 outputs the LP1' of high level in a period during which the count value of the second counter 303 is 0 (in a period during which the first counter 301 counts the values between 0 and 6). On the contrary, the mask signal DECMASK is at low level in a period during which the first counter 301 counts between 3 and 5. Therefore, in the case that the mask signal DECMASK of low level is generated, in a time period during this generation, the AND circuit 419 outputs the high level, thus generating the latch pulse LP1 of high level. Consequently, the latch pulse LP1 is prevented from becoming high level during the transitional period during which the count of the second counter 303 is changed. Thereafter, when the second counter 303 is incremented by +1, the same operation is performed. For example, if the count value of the second counter 303 is 1, that is, if the only SADR(1) among the bits of the second counter is 1 (binary value), the latch pulse LP2 becomes the high level in a period during which the count value of the first counter 301 is between 3 and 5. Subsequent operations are performed in the same manner.

===Operation of Liquid Crystal Driving Apparatus===

Figure 6:
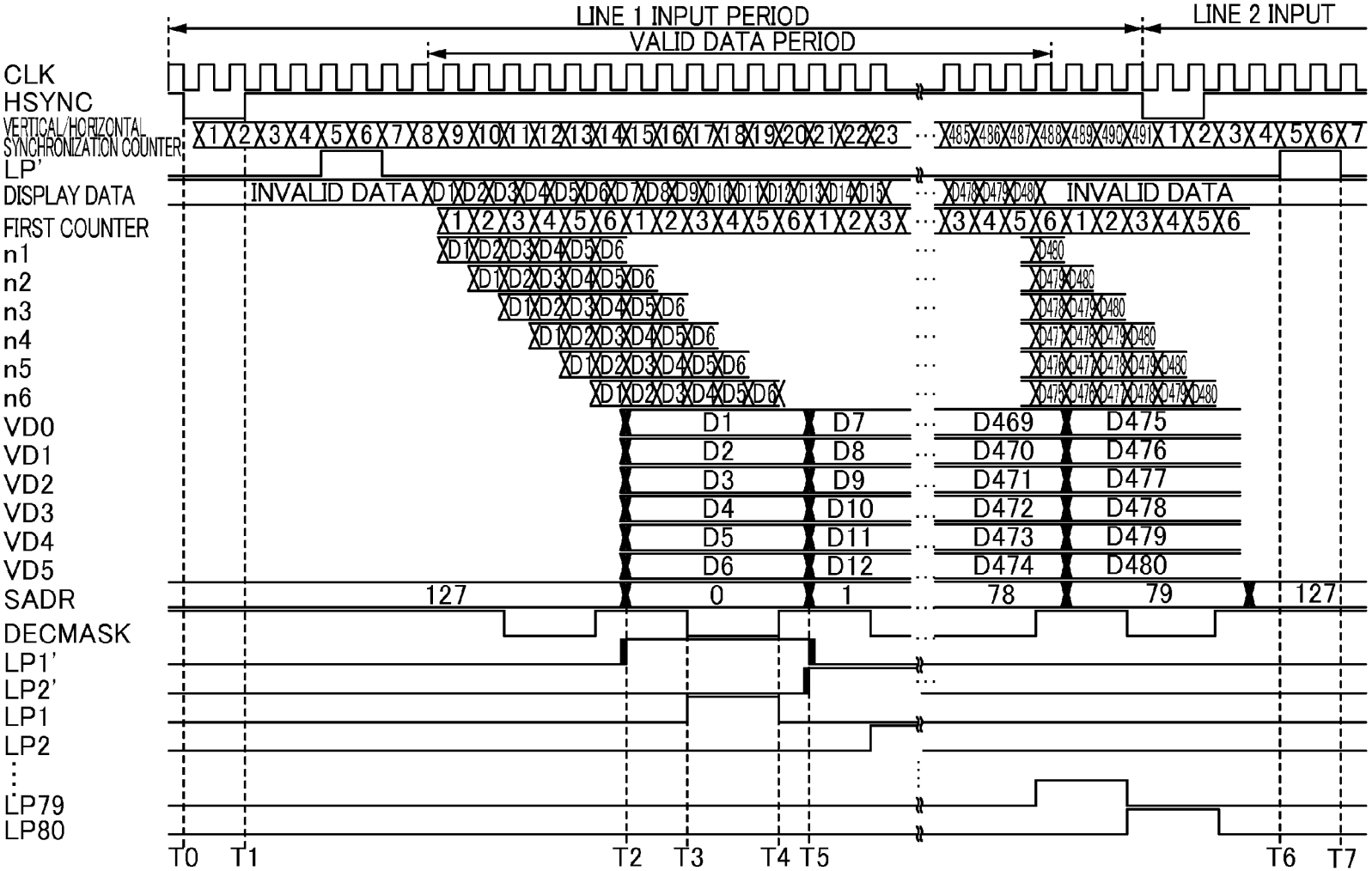
FIG. 6 is a timing chart of an operation of a liquid crystal driving apparatus according to an embodiment of the present invention.

An operation of the liquid crystal driving apparatus according to the present invention will hereinafter be described with reference to a timing chart shown in FIG. 6.

In an initial state, the clock CLK is input to necessary blocks included in the liquid crystal driving apparatus 300. It is assumed here that the display data is 8-bit wide. At this moment, the display data is not determined, that is, the display data is invalid. Therefore, the count value is obtained by the second counter 303 as 1 in all the bits, thereby representing a value of 127 (in decimal). The second decoder 305 includes a hard ware logic configured so as to decode the count value of 127 obtained by the second counter 303, but so as not to generate a latch pulse corresponding to the count value of 127. The mask signal DECMASK generated from the mask signal generating circuit 304 is fixed at the high level. The latch pulses LP1 to LP80 are all at the low level at this time.

From this state, when a horizontal synchronization signal HSYNC is input to the vertical/horizontal synchronization counter 308 and the horizontal synchronization signal HSYNC drops to the low level (at a time of T0), the count value of the vertical/horizontal synchronization counter 308 is reset. In synchronization with a rising edge of the clock CLK which is input right after the reset, the vertical/horizontal synchronization counter 308 counts up the count values. The horizontal synchronization signal HSYNC rises to the high level at a time of T1. The latch pulse generating circuit 203 generates the latch pulse LP'c the vertical/horizontal synchronization counter 308 counts 5 and 6 (in decimal), for example. The latch pulse LP' at this time causes the display data of 480×8 bits latched in the latch circuit 201 to be latched into the latch circuit 204, prior to display data of 480×8 bits D1 to D480 for one row described later being latched. The microcomputer 309: monitors, for example, a timing at which the horizontal synchronization signal HSYNC is generated; determines that there can be performed a valid liquid crystal display on the liquid crystal display 100 when the count value of the vertical/horizontal synchronization counter 308 is 8 or thereafter, for example, and starts inputting the display data D1 to D480 serially to the shift register 307 of the liquid crystal driving apparatus 300, in synchronization with the falling edge of the clock CLK.

The shift register 307 includes six 8-bit data holding areas n1 to n6, and receives and holds six units of 8-bit display data (D1 to D6, D7 to D12, . . . , D469 to D474, D475 to D480) serially in synchronization with the rising edge of the clock CLK. In other words, the shift register 307 is made up of 48 bits. The data register 200 also is made up of 48 bits. Therefore, each of the latch areas delimited by broken lines in the latch circuits 201 and 204 in FIG. 1, includes 48 bits, and 80 of these latch areas are provided. The D/A converter 205 is a group of 8-bit D/A converters of a predetermined number. More specifically, six of D/A converters are required to perform D/A conversion for the display data of 48-bit in each of the latch areas of the latch circuit 204. Units of six D/A converters are provided for the eighty latch areas. In other words, the D/A converter 205 includes 480 of 8-bit D/A converters. Therefore, analog values of 480 output from 480 of 8-bit D/A converters, are input to 480 of column electrodes 101 via the source output circuit 206. For example, if the display data D1 to D6 are held in the shift register 307, the count value of the first counter 301 is 6. Therefore, the first counter 301 outputs a hold signal to the data register 200 (time T2). By this hold signal, the data register 200 holds the display data D1 to D6 in 8-bit VD0 to VD5 at the time T2, each of 8-bit VD0 to VD5 making up each bit of data register 200.

At the timing of the time T2, at which the first counter 301 outputs the hold signal, since the first decoder 302 decodes, i.e. detects, the count value 6 of the first counter 301, the second counter 303 is incremented by +1 to become at the count value 0 from 127. In other words, since all the bits of the second counter 303 are at a count value of 0, only the NOR circuit 411 outputs LP1' of high level, as shown in FIG. 5, in a period during which the count value of the second counter 303 is 0 (between the time T2-T5). In a period during which the first counter 301 counts 3, 4, and 5 (T3 to T4), the mask signal DECMASK is at the low level. Therefore, there is output from the second decoder 305 the latch pulse LP1 which is at the high level only in a period during which the mask signal DECMASK is at the low level. During the period of time that the latch pulse LP1 is at the high level, the display data D1 to D6 held in the data register 200 are latched to the latch area 201-1 in the latch circuit 201. In this case, since the latch circuit 201 performs this latching operation in a period except the transitional period during which the count value of the second counter 303 is changed, a latch pulse is generated reliably for a designated latch area for latching in the latch circuit 201. Therefore, correct display data is latched to the latch circuit 201.

By repeating a similar operation, the display data D7 to D12 . . . D469 to D474, D475 to D480 are latched reliably to the latch areas 201-2 to 201-80 in the latch circuit 201. Thereafter, as described above, the latch pulse generating circuit 203 generates the latch pulse LP' in a period during which the vertical/horizontal synchronization counter 308 counts 5 and 6. By this latch pulse LP', the 480×8-bit display data D1 to D480 latched in the latch circuit 201, are latched to the latch circuit 204 during a period of time between T6 and T7. The subsequent operations are the same as descriptions for FIG. 8.

In the above manner, even if a latch pulse is generated for the latch circuit 201 based on a decoding result obtained by decoding the count value of the second counter 303 by the second decoder 305; since the transitional period, during which the value of the second counter 303 is changed, can be disregarded by providing the mask signal generating circuit 304; erroneous latching at the latching circuit 201 can be avoided. Thus, high-quality image can be displayed on the liquid crystal display panel 100. Furthermore, since the mask signal DECMASK is generated in a period fully including predetermined time before and after the transitional period of the second counter 303, it is possible to avoid an erroneous change caused by a disturbance, etc., in the count value of the second counter 303. As shown in FIG. 4, a period including the transitional period of the second counter 303 for the mask signal DECMASK to be at the low level is determined depending on the count value of the first counter 301 to be determined by the determiner 315. Therefore, a period during which the mask signal DECMASK is at the low level can be flexibly changed by design of the determiner 315, corresponding to specifications of the liquid crystal driving apparatus 300. Furthermore, some of the intermediary latch areas in the latch circuit 201 may not be used due to a change in number of the column electrodes 101 in accordance with a number of pixels on the liquid crystal display panel 100. Even in such a situation, only by configuring the hardware logic for the second decoder 305 accordingly, correct display data is reliably latched in the latch circuit 201 by virtue of the mask signal DECMASK obtained from the mask signal generated circuit 304 and the count value of the second counter 303.

The above embodiments of the present invention are simply for facilitating the understanding of the present invention and are not in any way to be construed as limiting the present invention. The present invention may variously be changed or altered without departing from its spirit and encompass equivalents thereof.

What is claimed is:

1. A liquid crystal driving apparatus comprising:

a latch circuit including a plurality of latch areas each in n-bit unit, the latch circuit being configured to sequentially latch a plurality of pieces of n-bit display data into a designated latch area of the latch areas, the plurality of pieces of n-bit display data being obtained by dividing m-bit display data for driving column electrodes corresponding to each of row electrodes of a liquid crystal display panel including a plurality of the row electrodes and a plurality of the column electrodes;

a data register configured to sequentially hold the plurality of pieces of n-bit display data; and a latch pulse generating circuit configured to generate a latch pulse for latching the n-bit display data into the designated latch area every time the data register holds the n-bit display data, the latch pulse generating circuit including:

a counter whose count value changes every time the data register holds the n-bit display data;

a decoder configured to decode the count value of the counter to generate the latch pulse; and a masking circuit configured to mask generation of the latch pulse from the decoder in a period of time during which the count value of the counter is changed, the column electrodes being driven based on the m-bit display data output from the latch circuit.

2. The liquid crystal driving circuit according to claim 1, further comprising a shift register configured to hold the n-bit display data in synchronization with a clock, wherein the latch pulse generating circuit further includes a signal output circuit including a counting unit configured to count up to a value of k, where k is an integer, in synchronization with the clock sequentially and repeatedly, the signal output circuit being configured to output a hold signal for causing the data register to hold the n-bit display data held in the shift register, and to output a signal for changing the count value of the counter, every time the value of k is counted by the counting unit, and wherein the mask circuit masks the generation of the latch pulse in a period of time during which the counting unit counts the value of k and values before and after the value of k.

3. The liquid crystal driving circuit according to claim 2, wherein the signal output circuit further includes a decoding unit configured to decode the count value of the counting unit, and the decoding unit outputs a signal for changing the count value of the counter when decoding that the counting unit counts the value of k, and outputs a signal for masking the latch pulse to the masking circuit when decoding that the counting unit counts the value of k and the values before and after the value of k.

* * * * *